US005079485A

United States Patent [19]

Hasemann et al.

[11] Patent Number: 5,079,485

[45] Date of Patent: Jan. 7, 1992

[54] BALLAST FOR SUPPLYING A PLURALITY OF DISCHARGE LAMPS

[75] Inventors: Fred Hasemann; Ferdinand Mertens; Norbert Wittig, all of Arnsberg, Fed. Rep. of Germany

[73] Assignee: Trilux-Lenze GmbH & Co. K.G., Arnsberg, Fed. Rep. of Germany

[21] Appl. No.: 595,537

[22] Filed: Oct. 11, 1990

[30] Foreign Application Priority Data

Nov. 22, 1989 [DE] Fed. Rep. of Germany ..... 3938676

[51] Int. Cl.[5] ..... H05B 41/14

[52] U.S. Cl. ..... 315/324; 315/153; 315/154; 315/320; 315/322

[58] Field of Search ..... 315/324, 322, 320, 317, 315/DIG. 5, 153, 154, 155

[56] References Cited

U.S. PATENT DOCUMENTS 2,859,387 11/1958 Ulffers ..... 315/324 X
4,238,711 12/1980 Wallot ..... 315/324
4,247,766 1/1981 Warren et al. ..... 315/154 X
4,260,932 4/1981 Johnson ..... 315/DIG. 5 X
4,484,105 11/1984 Kriete et al. ..... 315/322 X
4,947,086 8/1990 Hagano ..... 315/DIG. 5 X

*Primary Examiner*—Eugene R. LaRoche
*Assistant Examiner*—Do Hyum Yoo
*Attorney, Agent, or Firm*—Spensley Horn Jubas & Lubitz

[57] ABSTRACT

A device which enables a plurality of discharge lamps that are connected to a common ballast to be turned on and off separately via external switches. The operation circuit of the ballast is connected to the external switches through decouplers. The operation circuit may be supplied with voltage via any of the decouplers. A detector detects which of the switches has been closed and closes a logic member in the lamp circuit of the discharge lamp concerned. Consequently, the only lamp circuits that are closed are those in which the detectors have responded.

8 Claims, 1 Drawing Sheet

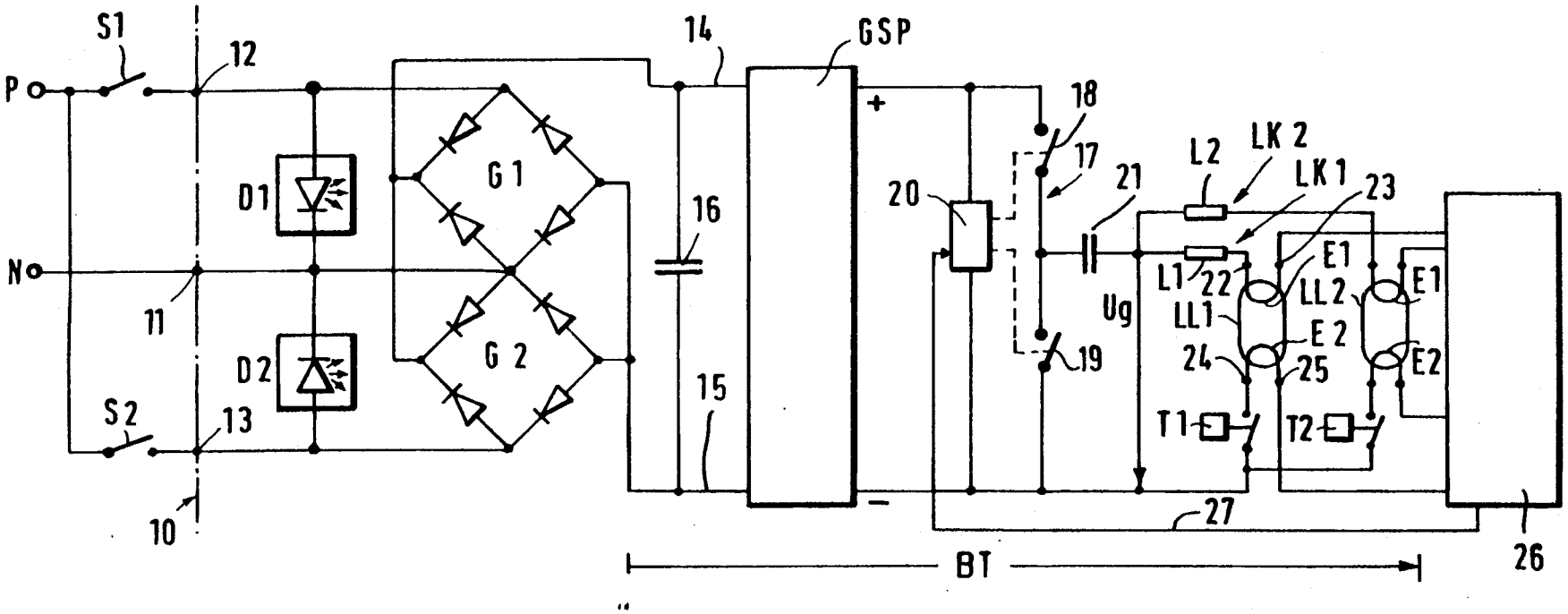
26
E1
E2
23
E1
LL2
E2
25
T2
LK1
LK2
L2
L1
22
LL1
24
T1
27
21
Ug
18
17
19
BT
20
GSP
+
-
14
16
15
G1
G2
D1
D2
12
13
11
10
S1
S2
P
N

BALLAST FOR SUPPLYING A PLURALITY OF DISCHARGE LAMPS

BACKGROUND OF THE INVENTION

1. Field of the Invention

The present invention relates to a ballast for supplying a plurality of discharge lamps.

2. Description of Related Art

Discharge lamps, like fluorescent lamps, require a supply ballast that generates the operational voltage needed for the operation of the discharge lamps from the mains voltage, and which, moreover, allows the ignition of the discharge lamps and, possibly, the preheating of the lamp electrodes.

Normally, each discharge lamp has its own ballast. However, ballasts are known that can operate a plurality of discharge lamps simultaneously. Such ballasts have an operational member, wherein each discharge lamp has its own respective lamp circuit containing electrode terminals between which the lamp is inserted. In addition, a separate inductance is provided for each lamp, which generates the high voltages necessary for the ignition of the lamp during the ignition phase.

Ballasts that are designed for the simultaneous operation of a plurality of discharge lamps, however, can only be operated such that all connected discharge lamps are either on or off. Thus, it is not possible to turn an individual discharge lamp or a group discharge lamps on or off independently from the other discharge lamps connected to the ballast.

It is an object of the present invention to provide a ballast that allows individual discharge lamps and groups of discharge lamps to be turned on and off separately, without thereby influencing the remaining discharge lamps operated by the ballast.

SUMMARY OF THE INVENTION

In accordance with the present invention, this and other objectives are achieved by providing a ballast having an operation circuit which may be turned on through a plurality of external switches. A decoupler is connected between each of the external switches and the operation circuit. Due to the presence of the decouplers, the mains voltage applied via the external switches is transferred to the operation circuit, but the occurrence of feedback between one switch and another switch is prevented.

Each decoupler has a corresponding detector assigned thereto. The detector will only respond if the switch assigned to a corresponding decoupler is closed. Each detector controls a logic element contained in a lamp circuit assigned to the detector. Consequently, the lamp circuit will be closed only if the detector responds, which occurs only if the external switch assigned to the detector is closed. In this way, the operation circuit may be supplied with voltage via each of the plurality of external switches, while the only lamp circuits that are closed are those lamp circuits which are assigned to external switches that have been closed. The other lamp circuits remain open, and the discharge lamps assigned to these open lamp circuits remain turned off.

Although there is only one common operation circuit for all lamps, each lamp (or each group of lamps) may be turned on or off separately. This leads to a reduction of the number of ballasts and to an increase in the possibilities of switching individual lamps or groups of lamps separately.

If more than one external switch is enabled, the operation circuit is connected to the mains voltage via a plurality of external switches. It is always the largest amplitude of the different mains voltage that is transferred to the operation circuit. It is not absolutely necessary that all switches are connected to the same phase of the mains voltage. In the case of a three-phase mains, the external switches may also be connected to different phases of the mains.

BRIEF DESCRIPTION OF THE DRAWINGS

A detailed description of a preferred embodiment of the invention will be made with reference to the accompanying drawing, which shows a schematic illustration of a circuit diagram of a ballast.

DETAILED DESCRIPTION OF PREFERRED EMBODIMENTS

The following detailed description is of the best presently contemplated mode of carrying out the invention. This description is not to be taken in a limiting sense, but is made merely for the purpose of illustrating the general principles of the invention. The scope of the invention is best defined by the appended claims.

As illustrated in the figure, the input of the ballast 10 has an input terminal 11 that may be connected to a terminal of the mains voltage; e.g., the neutral conductor. The input of the ballast 10 also has a plurality of further terminals 12 and 13 that may each be connected to a respective external switch. In the illustrated embodiment, the switches S1 and S2 at the input are connected to a phase lead P of the mains system.

The terminals 11 and 12 are connected to the input terminals of a full-wave rectifier G1. The output terminals of the full-wave rectifier G1 are connected to the input leads 14 and 15 of the operation circuit BT. The terminals 11 and 13 are connected to the input terminals of a full-wave rectifier G2. The output terminals of the full-wave rectifier G2 are connected to the input leads 14 and 15 of the operation circuit BT. A capacitor 16 is connected between the input leads 14 and 15.

A detector D1 is connected between the terminals 11 and 12. The detector D1 detects whether the switch S1 is closed or whether a mains voltage is present at the terminals 11 and 12. The detector D1 is the photo diode of an optocoupler comprising the elements D1 and T1. Similarly, a detector D2 is provided between the terminals 11 and 13. The detector D2 is the photo diode of an optocoupler comprising the elements D2 and T2.

The full-wave rectifiers G1 and G2 act as decouplers. When the switch S1 is closed, the mains voltage will reach the detector D1 only. If the switch S2 remains open, the decouplers will prevent the mains voltage from also reaching the detector D2. Thus, the only detectors that will respond are those detectors for which the associated external switch is closed. Each decoupler supplies its output voltage to the input leads 14 and 15 of the operation circuit BT.

The operation circuit BT includes a direct voltage generator GSP for generating a continuous direct voltage of a predetermined amplitude from the pulsating direct voltage present at the input leads 14 and 15. The amplitude of the continuous direct voltage is generally higher than the peak amplitude of the mains voltage. Such direct voltage generators are known as boost converters or inverse regulators and are not described in detail herein.

The output of the direct voltage generator GSP has an inverted rectifier 17 connected thereto. The inverted rectifier 17 comprises two series-connected electronic switches 18 and 19 controlled by a control circuit 20 such that the two switches 18 and 19 are turned on alternatively; i.e., one of the switches is turned on while the other switch is turned off. The electronic switches 18 and 19 are switched at a frequency above 20 kHz. At the node of the switches 18 and 19, the lamp circuits LK1 and LK2 of the discharge lamps are connected via a capacitor 21. In the illustrated example the lamps are fluorescent lamps LL1 and LL2.

The lamp circuit LK1 includes, in series connection, an inductance L1 connected to the capacitor 21, the fluorescent lamp L1, and the logic element T1. The logic element T1 is the bidirectional switch of the optocoupler comprising the elements D1 and T1. The logic element T1 is connected to one pole of the direct voltage generated by the direct voltage generator GSP.

The fluorescent lamp LL1 contains two electrodes E1 and E2, each electrode having two ends connected to the electrode terminals 22 and 23 and to the electrode terminals 24 and 25 of the ballast. In the illustrated embodiment, the electrode terminals 22 and 24 are the live electrode terminals through which the electrodes E1 and E2 are supplied with voltage. The electrode terminals 23 and 25 facing away from the live electrode terminals 22 and 24 are connected to a control circuit 26. The logic element T1 is series-connected with the live electrode terminal 24, which faces away from the associated inductance L1 and through which the electrode E2 is connected to the one pole of the generator voltage $U_g$ provided by the inverted rectifier 17.

The lamp circuit LK2 of the fluorescent lamp LL2 also comprises an inductance L2 connecting the electrode E1 to the one pole of the generator voltage $U_g$, and a logic element T2 connecting the other electrode E2 to the other pole of the generator voltage $U_g$. The electrode terminals facing away from the live electrode terminals are connected to the control circuit 26.

The illustrated ballast operates as follows: If the external switch S1 is closed and the external switch S2 remains open, then the full-wave rectifier G1 is provided with alternating voltage and generates the supply voltage at the input leads 14 and 15 of the operation circuit. Simultaneously, the detector D1 is energized while the detector D2 remains deenergized. The actuation of the detector D1 closes the switch T1, whereby the lamp circuit LK1 is closed, while the lamp circuit LK2 remains open, since the switch T2 keeps this lamp circuit interrupted.

As soon as the generator voltage $U_g$ has been established, the control circuit 26 first short-circuits the electrode terminals 23 and 25 of all discharge lamps, facing away from the generator voltage. Consequently, in those discharge lamps having their switches T1 or T2 closed, the preheating period starts, during which the electrodes E1 and E2 are preheated. After a pre-determined duration of the preheating period, the control circuit 26 generates a predetermined number of burst pulses during an ignition period, during which the electrode terminals 23 and 25 are alternately short-circuited and decoupled. The interruption of the electrode current effected thereby causes a high ignition voltage at the respective associated inductance L1.

After the ignition period has ended, the operation period is started during which the control circuit continuously interrupts the connection between the electrode terminals 23 and 25.

The control circuit 26 is connected to the control circuit 20 of the inverted rectifier 17 via a line 27. During the preheating period and the ignition period, which are both controlled by the control circuit 26, the control circuit 20 generates a comparatively low operational frequency of the inverted rectifier 17 of slightly above 20 kHz. During the operational period, the control circuit 20 generates a higher operational frequency of the inverted rectifier 17 of the approximately 35 kHz.

The control circuit 26 synchronously effects the same control of all connected fluorescent lamps, but the only fluorescent lamps which respond are those that have the logic element T1 or T2 closed.

If, after the external switch S1 has been closed, the switch S2 is also closed, then the direct voltage generator GSP is provided with voltage via both full-wave rectifiers G1 and G2. The control circuit 26 detects the closed state of the logic element T2 and the preheating period, the ignition period and the operational period are performed successively for all fluorescent lamps LL1 and LL2, as described above. In doing so, the already lit fluorescent lamp LL1 will be extinguished for a moment, but the preheating period and the ignition period are so short that this extinguishing is practically imperceptible.

The presently disclosed embodiment is to be considered in all respects as illustrative and not restrictive, the scope of the invention being indicated by the appended claims, rather than the foregoing description, and all changes which come within the meaning and range of equivalency of the claims are therefore intended to be embraced therein.

What is claimed is:

1. A ballast for supplying a plurality of discharge lamps, comprising:

an operation circuit including a plurality of lamp circuits, a plurality of logic elements for opening and closing the lamp circuits, a plurality of decouplers through which the operation circuit is supplied with voltage, a plurality of switches, each of the switches independently connecting one of the decouplers to a voltage source, and a plurality of detectors, each of the detectors being operationally associated with one of the decouplers, each of the detectors operating to detect the presence of voltage at one of the decouplers and to close one of the logic elements in response to the presence of voltage at the decoupler.

2. The ballast of claim 1, wherein at least one of the decouplers comprises a rectifier for converting voltage from the voltage source into a pulsating direct voltage.

3. The ballast of claim 1, wherein at least one of the detectors and at least one of the logic elements are operationally connected to form a relay.

4. The ballast of claim 1, wherein at least one of the detectors and at least one of the logic elements are operationally connected to form an optocoupler.

5. The ballast of claim 1, wherein at least one of the lamp circuits comprises an inductance and at least two electrode terminals.

6. The ballast of claim 1, wherein the discharge lamps comprise fluorescent lamps having a plurality of electrodes, wherein at least one of the electrodes includes two electrode terminals through which the electrode is provided with voltage, and wherein one of the logic elements is connected to the electrode terminals.

7. The ballast of claim 5, further comprising:

a common control circuit for controlling a preheating period, an ignition period and an operational period for the lamp circuits.

8. A ballast for supplying a plurality of discharge lamps, comprising:

an operation circuit including a plurality of lamp circuits, a plurality of logic means for opening and closing the lamp circuits, a plurality of decoupler means for supplying the operation circuit with voltage, a plurality of switch means for independently connecting each of the decoupler means to a voltage source, and a plurality of detector means, each of the detector means being operationally associated with one of the decoupler means, for detecting the presence of voltage at one of the decoupler means and for closing one of the logic means in response to the presence of voltage at the decoupler means.

* * * * *